US005127363A

United States Patent [19]

Nakamura et al.

[11] Patent Number: 5,127,363

[45] Date of Patent: Jul. 7, 1992

[54] PAINTING SYSTEM FOR AUTOMOBILES

[75] Inventors: Satoru Nakamura; Jyunji Ito; Mitsuyoshi Obata, all of Kobe, Japan

[73] Assignee: Kabushiki Kaisha Kobe Seiko Sho, Kobe, Japan

[21] Appl. No.: 664,854

[22] Filed: Mar. 5, 1991

[30] Foreign Application Priority Data

Mar. 5, 1990 [JP] Japan ..... 2-54728
Jul. 17, 1990 [JP] Japan ..... 2-189129
Jul. 20, 1990 [JP] Japan ..... 2-193596

[51] Int. Cl.[5] ..... B05B 1/02; B05B 13/04

[52] U.S. Cl. ..... 118/695; 118/698; 118/699; 118/704; 118/302; 118/315; 118/323; 134/104.1; 239/112; 901/43

[58] Field of Search ..... 118/695, 698, 699, 703, 118/302, 313, 323, 704; 134/104.1; 239/112, 106, 290; 901/43, 50

[56] References Cited

U.S. PATENT DOCUMENTS 3,348,774 10/1967 Wiggins ..... 239/112
4,200,232 4/1980 Fraley et al. ..... 239/112
4,534,802 8/1985 Gates et al. ..... 239/112
4,721,630 1/1988 Takeo et al. ..... 901/43
4,830,882 5/1989 Ichinose et al. ..... 118/302
4,988,260 1/1991 Kiba et al. ..... 901/43

FOREIGN PATENT DOCUMENTS 53-72377 6/1978 Japan ..... 134/104.1
1287951 2/1987 U.S.S.R. ..... 239/112
2190312 11/1987 United Kingdom .
2198033 6/1988 United Kingdom .

OTHER PUBLICATIONS

Patent Abstracts of Japan, vol. 8, No. 246 (C-251), Nov. 10, 1984 & JP-A-59 127 671 (Nissan Jidosha KK) Jul. 23, 1984.

*Primary Examiner*—W. Gary Jones
*Assistant Examiner*—Todd J. Burns
*Attorney, Agent, or Firm*—Oblon, Spivak, McClelland, Maier & Neustadt

[57] ABSTRACT

A painting system for an automobile for washing an automobile using a plurality of robots comprises a plurality of washing apparatus disposed in the proximity of robots for individually washing the robots. The robots operate in accordance with a program taught in advance and is automatically washed by the washing apparatus after a suitable interval of time.

7 Claims, 19 Drawing Sheets

PAINTING SYSTEM FOR AUTOMOBILES

BACKGROUND OF THE INVENTION

1. Field of the Invention

This invention relates to a painting system for an automobile which includes a plurality of robots for painting an automobile.

2. Description of the Prior Art

In a painting line for automobiles, painting is performed also for various inside faces of an automobile while opening/closing members such as doors, a trunk and a bonnet are held in an open condition.

In particular, as shown, for example, in FIGS. 8(*a*), 8(*b*) and 8(*c*), a plurality of robots including a plurality of painting robots 41, a pair of door openers 42, a trunk opener 43 and a bonnet opener 44 are disposed on the opposite sides of a conveyor along which an automobile 40 is transported.

An engaging pin 48 is attached to an end portion of an arm of each of the door openers 42 and is fitted, for example, into a door groove for a glass window of one of doors 45 of the automobile 40 and drives the door opener 42 to move along a predetermined locus to open the door 45. After then, painting is performed for the inside of the automobile 40 and rear faces of the doors 45 by a pair of ones of the painting robots 41.

Meanwhile, an opener jig 49 is attached to an end portion of an arm of the trunk opener 43 and is engaged with an end portion of a trunk 46 of the automobile 40. Then, when the trunk opener 43 is driven to move along a predetermined locus taught in advance, the trunk 46 is opened. After then, painting is performed for the inside of the trunk 46 and a rear face of the trunk 46 by one of the painting robots 41 corresponding to the trunk opener 43.

Furthermore, another opener jig 50 is attached to an end portion of an arm of the bonnet opener 44 and is engaged with an end portion of a bonnet 47 of the automobile 40. Then, when the bonnet opener 44 is driven to move along a predetermined locus taught in advance to open the bonnet 47. After then, painting is performed for the inside of an engine room and a rear face of the bonnet 47 by one of the painting robots 41 corresponding to the bonnet opener 44.

After painting is performed for the various inner portions of the automobile 40 is such a manner as described above, the doors 45, trunk 46, bonnet 47 and so forth are closed by the door opener 42, trunk opener 43, bonnet opener 44 and so forth, respectively. After then, the automobile 40 is transferred to a next step.

By the way, in such a painting system as described above, while the inside of the automobile 40, the inside of the trunk 46 and the inside of the engine room are being painted, the doors 45, trunk 46 and bonnet 47 are held in the respective open conditions by the engaging pins 48 and opener jigs 49 and 50 provided at the end portions of the arms of the respective robots. Accordingly, paint mist sticks to the end portions of the arms of the openers. Further, paint mist rebounded in the insides of the various portions of the automobile 40 also sticks to the end portions of the arms of the painting robots 19 which perform painting operation.

If such paint mist sticks until it presents an accumulative condition, there is the possibility that operation of any of the openers and robots may be disabled or such paint mist in an accumulative condition may drop, during painting operation, to a painted face and cause a dissatisfactory result of painting Thus, it is conventionally standardized to wrap a vinyl tape or the like, for example, around an arm portion, a revolute joint or the like of each opener or robot and exchange the vinyl tape during a rest time or for each holiday. For any other portion around which a vinyl tape or the like cannot be wrapped, it is standardized to clean a location to which paint mist sticks with thinner during a rest time or after completion of required operation.

However, since those means involve manual operation by an operator, they are very cumbersome to the operator. Simultaneously, a considerably long period of time is required, which results in deterioration of the production efficiency and increase of the production cost.

SUMMARY OF THE INVENTION

It is an object of the present invention to provide a painting system for an automobile which has a function of washing various openers and robots to remove paint mist sticking to such openers and robots very readily without requiring manual operation of an operator.

In order to attain the object, according to the present invention, there is provided a painting system for an automobile for painting an automobile using a plurality of robots, which comprises a washing apparatus disposed in the proximity of each of the robots for washing the robot, and controlling means for controlling the robots to operate to paint the automobile and controlling the washing apparatus and the robots to operate to wash the robots after a suitable interval of time.

With the painting system, the washing apparatus for washing the robots are disposed individually in the proximity of the robots, and the robots operate in accordance with a program taught in advance to automatically wash the robots after a suitable interval of time.

Consequently, paint mist sticking to the robots can be washed away very readily without requiring any manual operation of an operator.

Accordingly, the painting systmem of the present invention contributes considerably to improvement in production efficiency and reduction in production cost.

BRIEF DESCRIPTION OF THE DRAWINGS

FIG. 3(*b*) is a plan view of the apparatus shown in FIG. 3(*a*);

FIG. 3(*c*) is a right-hand side elevational view of the apparatus shown in FIG. 3(*a*);

FIG. 3(*d*) is a left-hand side elevational view of the apparatus shown in FIG. 3(*a*);

FIG. 4(*b*) is a plan view of the apparatus shown in FIG. 4(*a*);

FIG. 4(*c*) is a right-hand side elevational view of the apparatus shown in FIG. 4(*a*);

FIG. 4(*d*) is a left-hand side elevational view of the apparatus shown in FIG. 4(*a*);

FIG. 4(*e*) is a sectional view taken along line A-A of FIG. 4(*a*);

FIG. 5(*b*) is a side elevational view as viewed in the direction indicated by an arrow mark D in FIG. 5(*a*);

FIG. 5(*c*) is a sectional view taken along line B-B' of FIG. 5(*a*);

FIG. 5(*d*) is a sectional view taken along line C-C' of FIG. 5(*a*);

FIG. 6(*b*) is a side elevational view, partly broken, of the apparatus shown in FIG. 6(*a*);

FIG. 7(*b*) is a flow chart illustrating a detailed procedure of a washing operation in the procedure shown in FIG. 7(*a*);

FIG. 7(*c*) is a flow chart illustrating a detailed procedure of another washing operation in the procedure shown in FIG. 7(*a*);

FIG. 8(*b*) is a perspective view of essential part of the painting system shown in FIG. 8(*a*); and FIG. 8(*c*) is a plan view of essential part of the painting system shown in FIG. 8(*a*).

DETAILED DESCRIPTION OF THE PREFERRED EMBODIMENT

In the following, a preferred embodiment of the present invention will be described in detail with reference to the accompanying drawings to facilitate understanding of the invention. It is to be noted that the embodiment described below is an exemplary form of the present invention and is not of the nature to restrict the technical scope of the present invention.

Figure 8A:
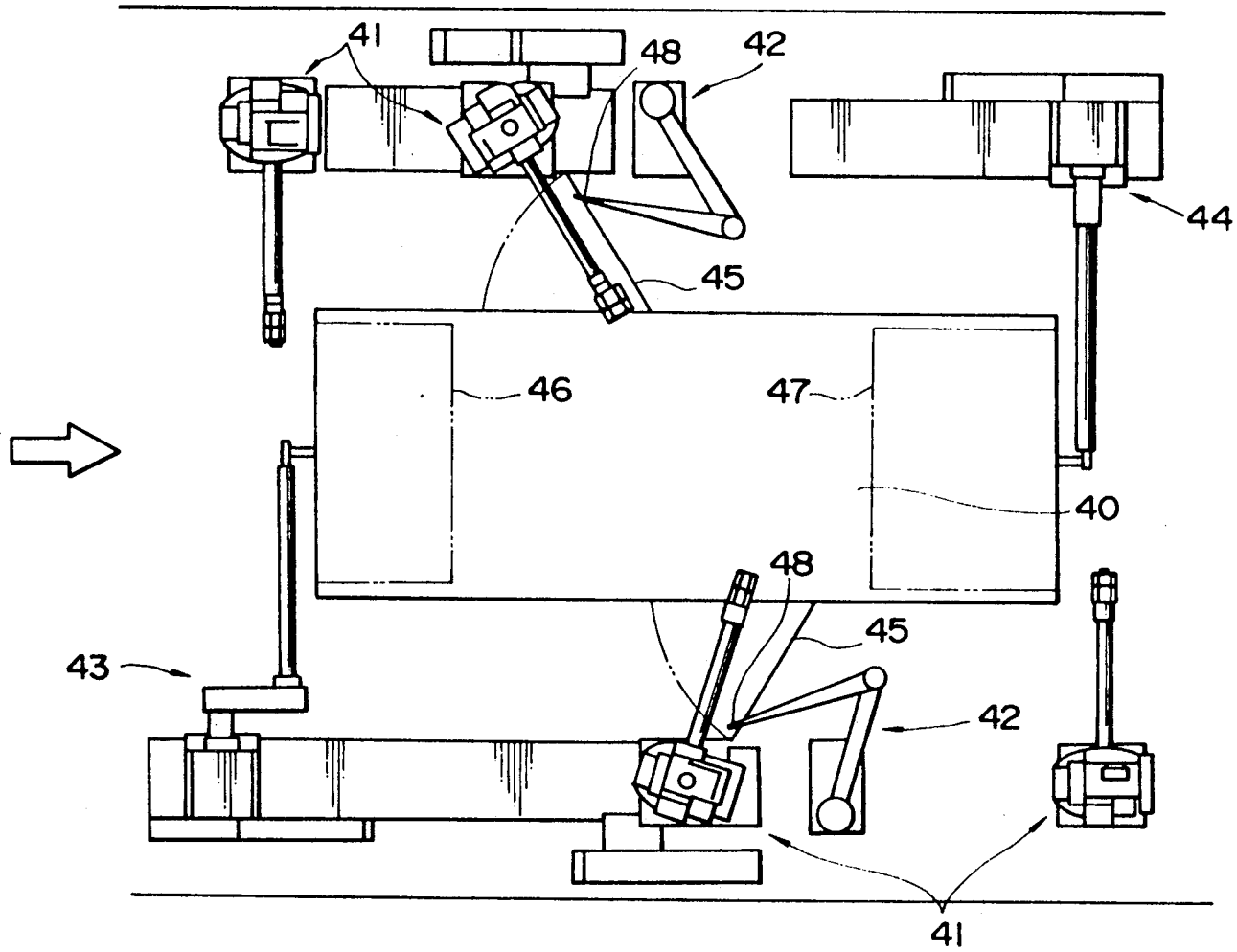
FIG. 8(a) PRIOR ART
FIG. 8(*a*) is a plan view showing general construction of a conventional painting system.
Figure 8B:
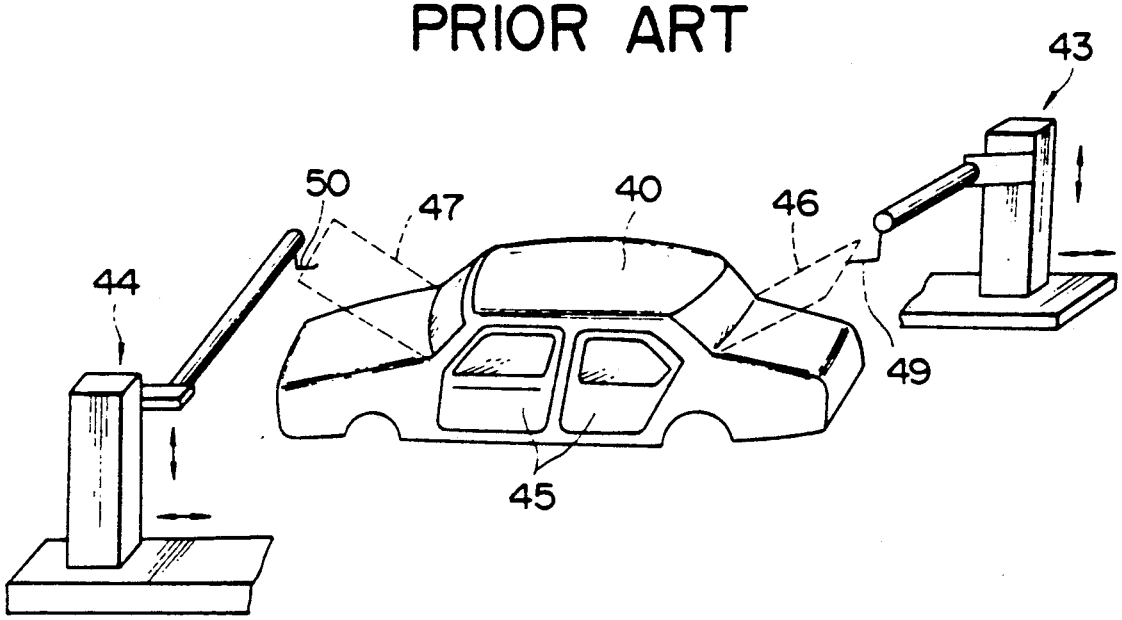
FIG. 8(b) PRIOR ART
Figure 8C:
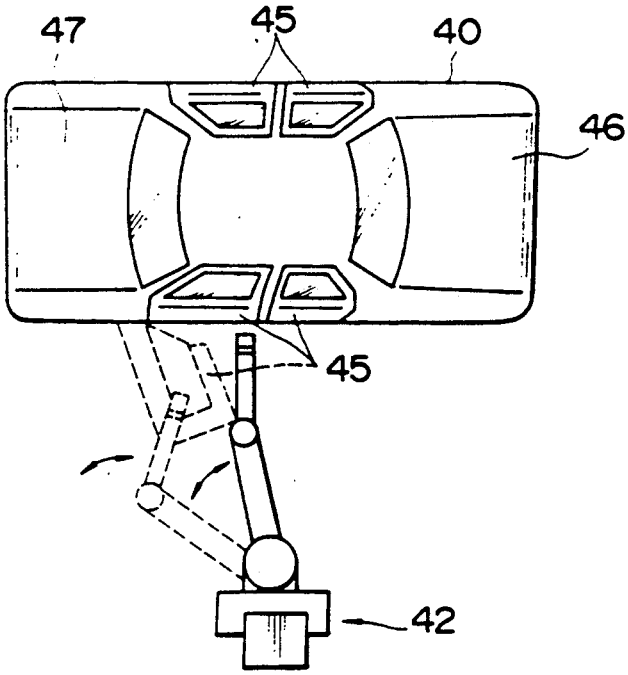
FIG. 8(c) PRIOR ART

Further, various elements common with those of the conventional painting system described hereinabove with reference to FIGS. 8(*a*) to 8(*c*) are denoted by common reference numerals, and overlapping description thereof will be omitted herein.

Figure 1:
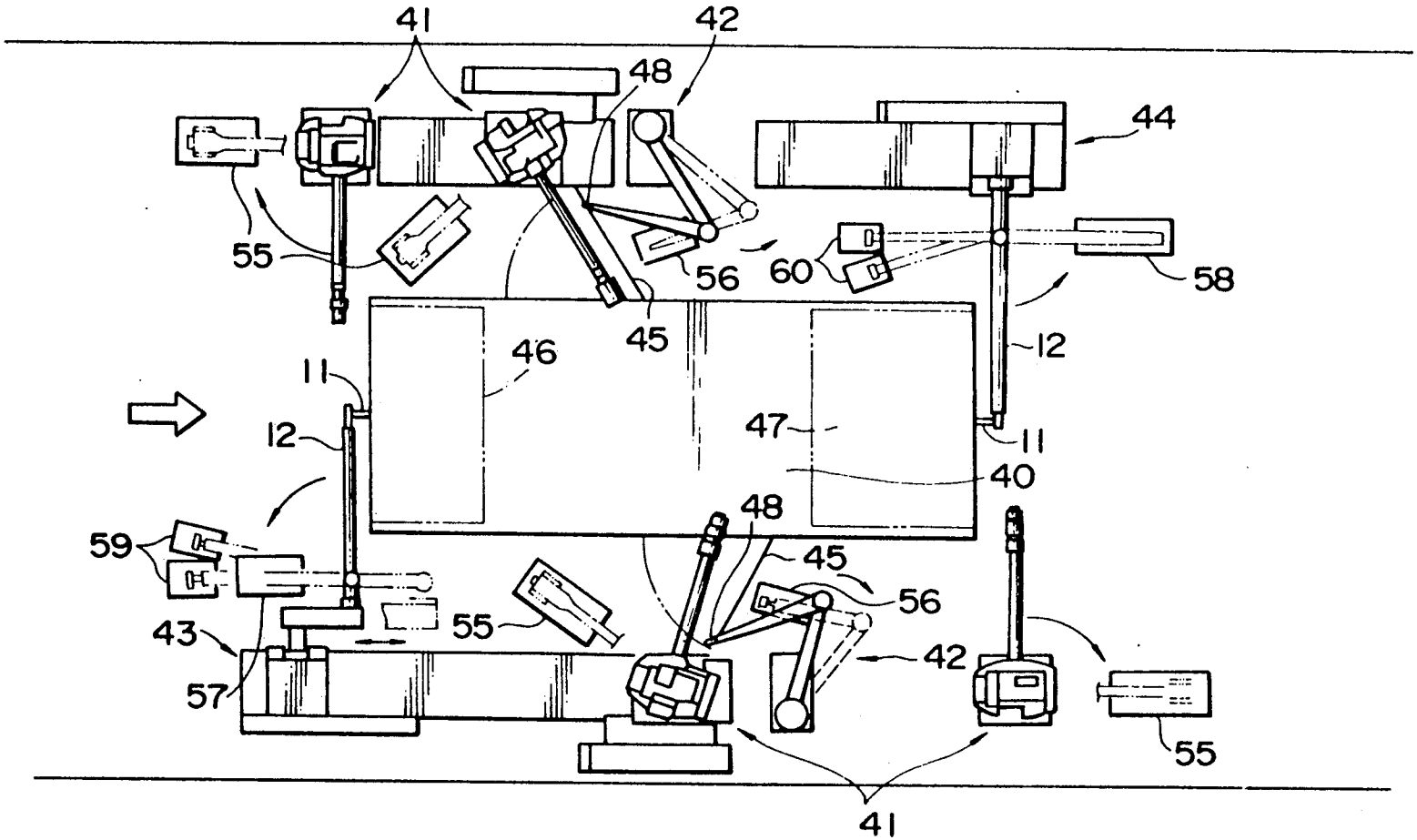
FIG. 1 is a plan view showing general construction of essential part of a painting system for an automobile according to an embodiment of the present invention.
Figure 2:
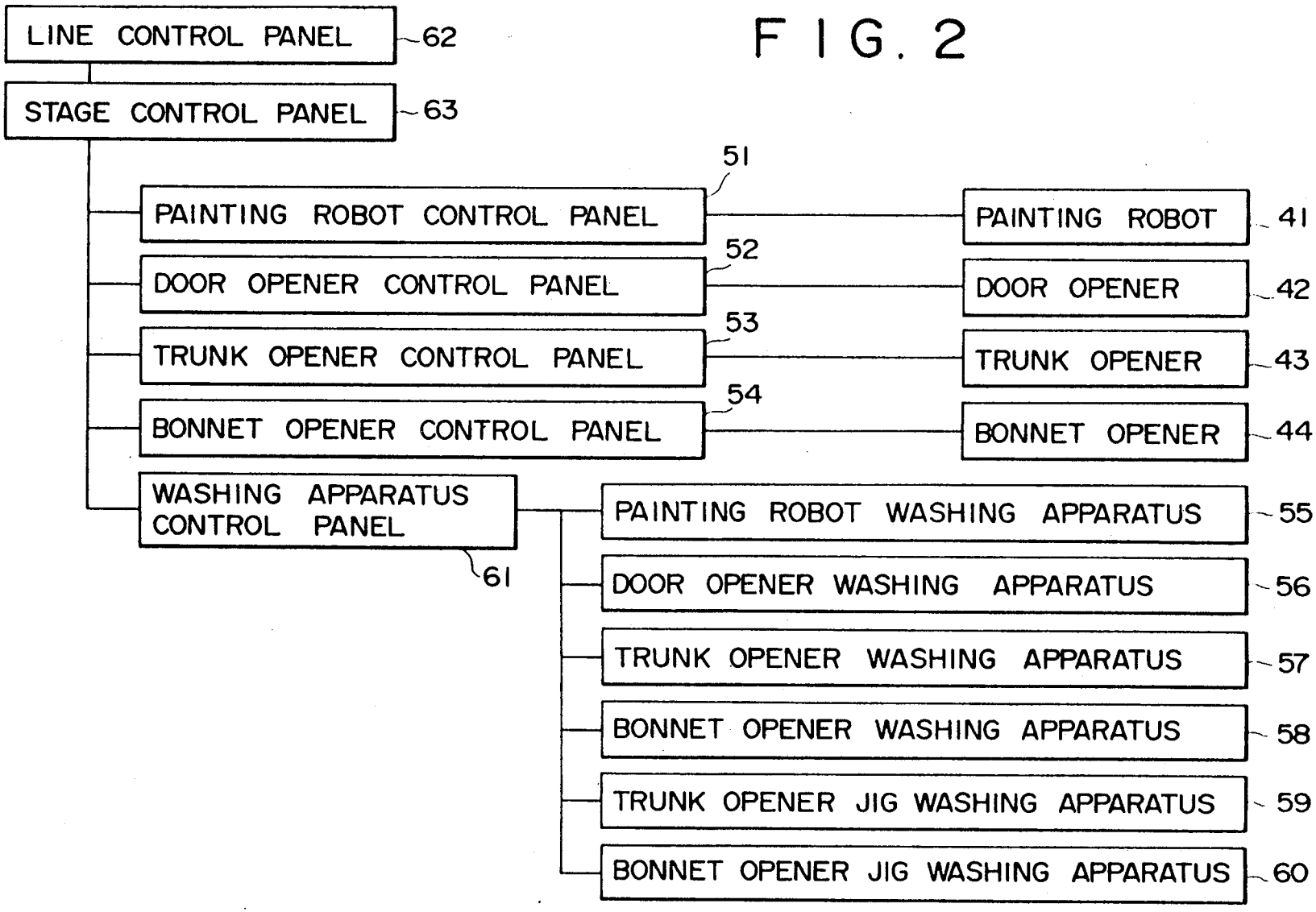
FIG. 2 is a schematic block diagram of a controlling system of the painting system.
Figure 3A:
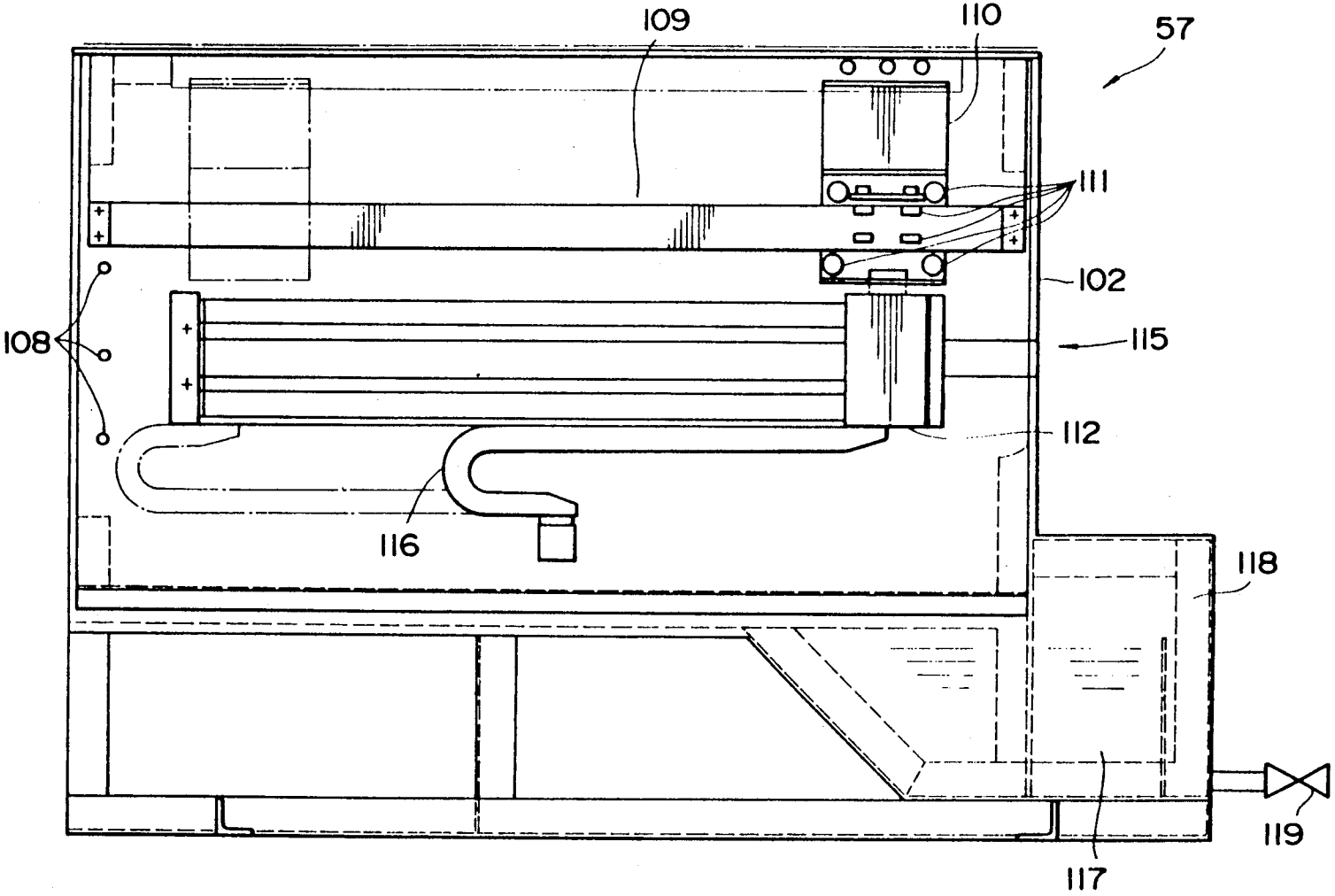
FIG. 3(*a*) is a front elevational view showing structure of an apparatus for washing an arm of one of robots constituting the painting system.
Figure 3B:
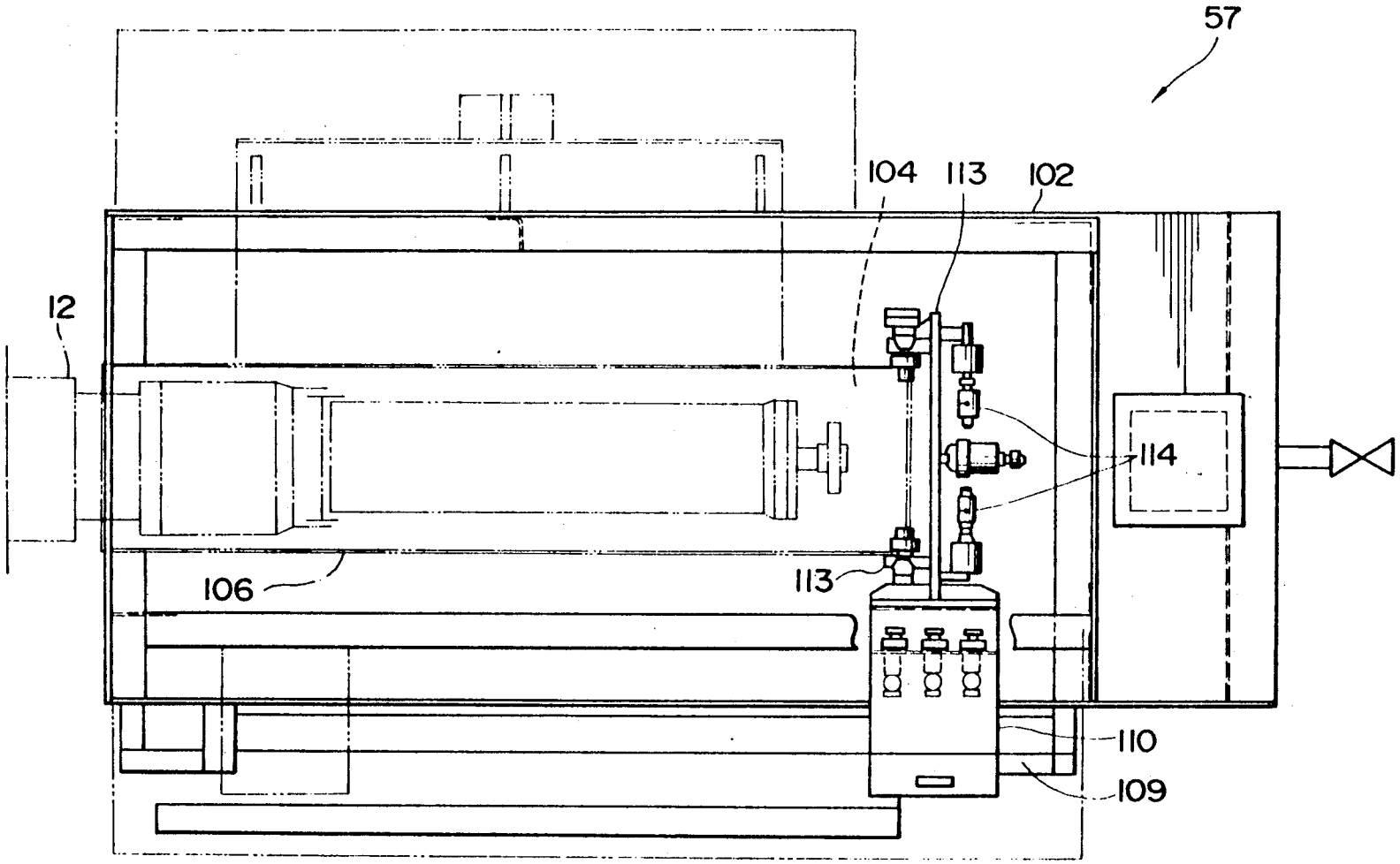
Figure 3C:
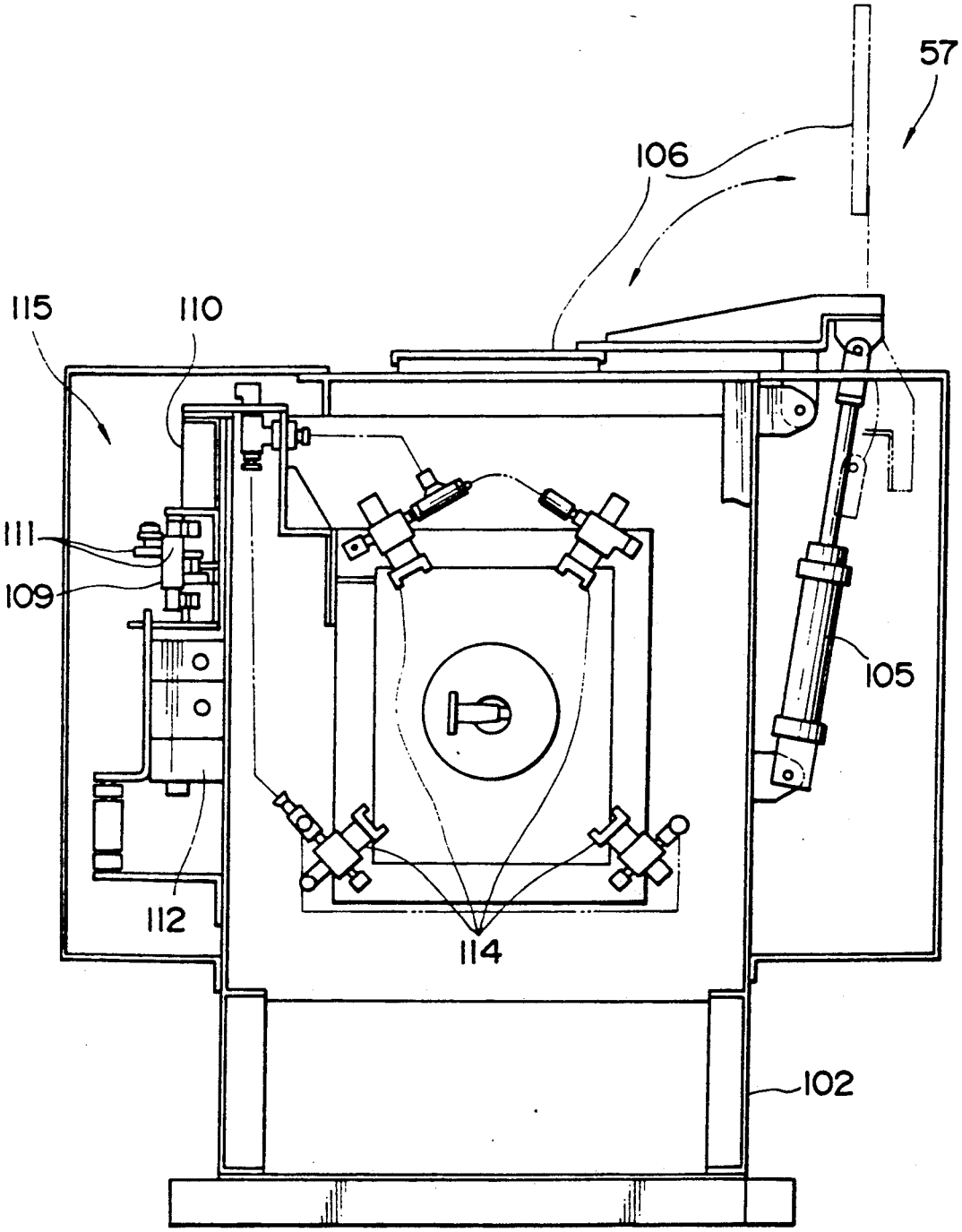
Figure 3D:
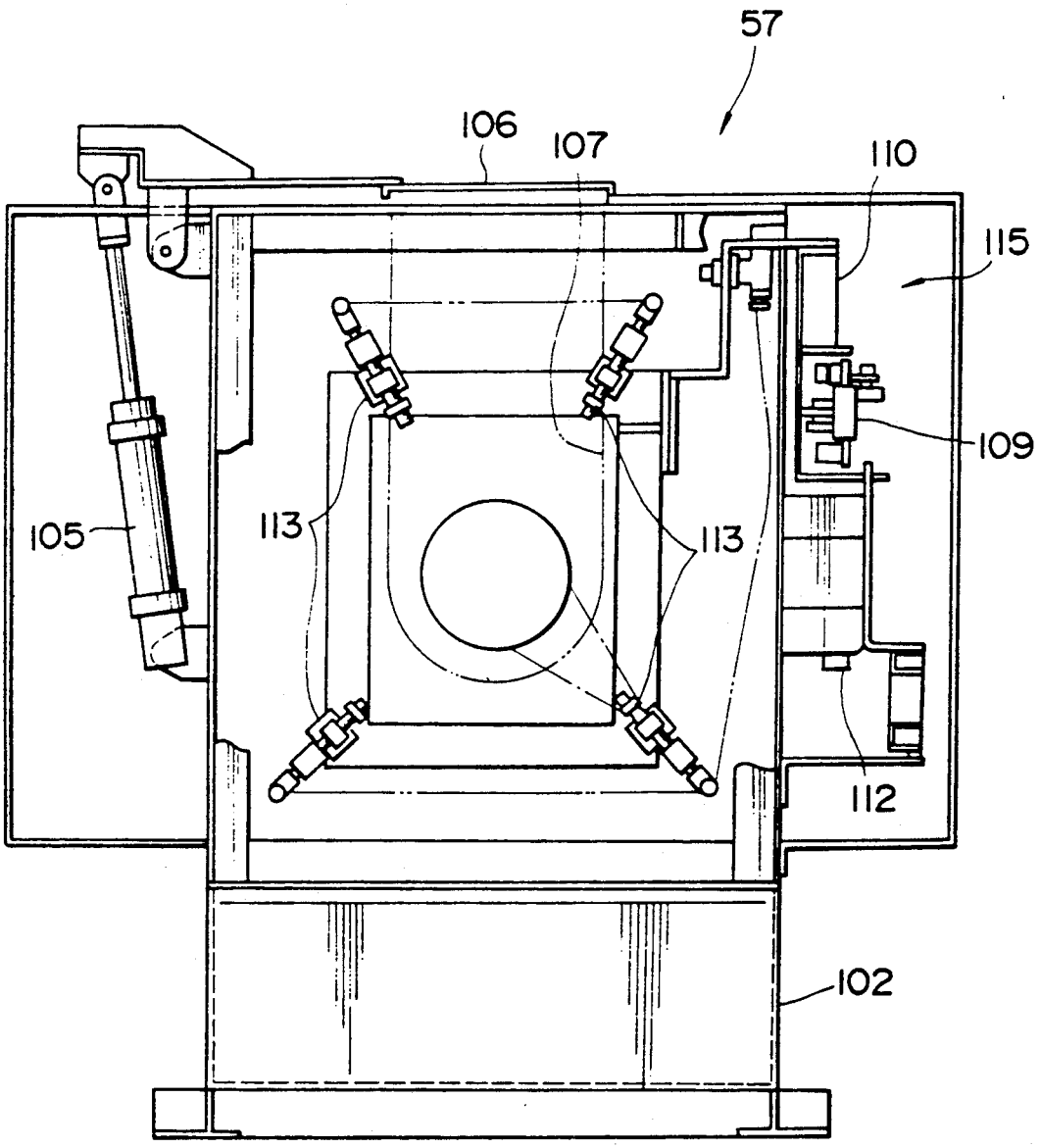
Figure 4A:
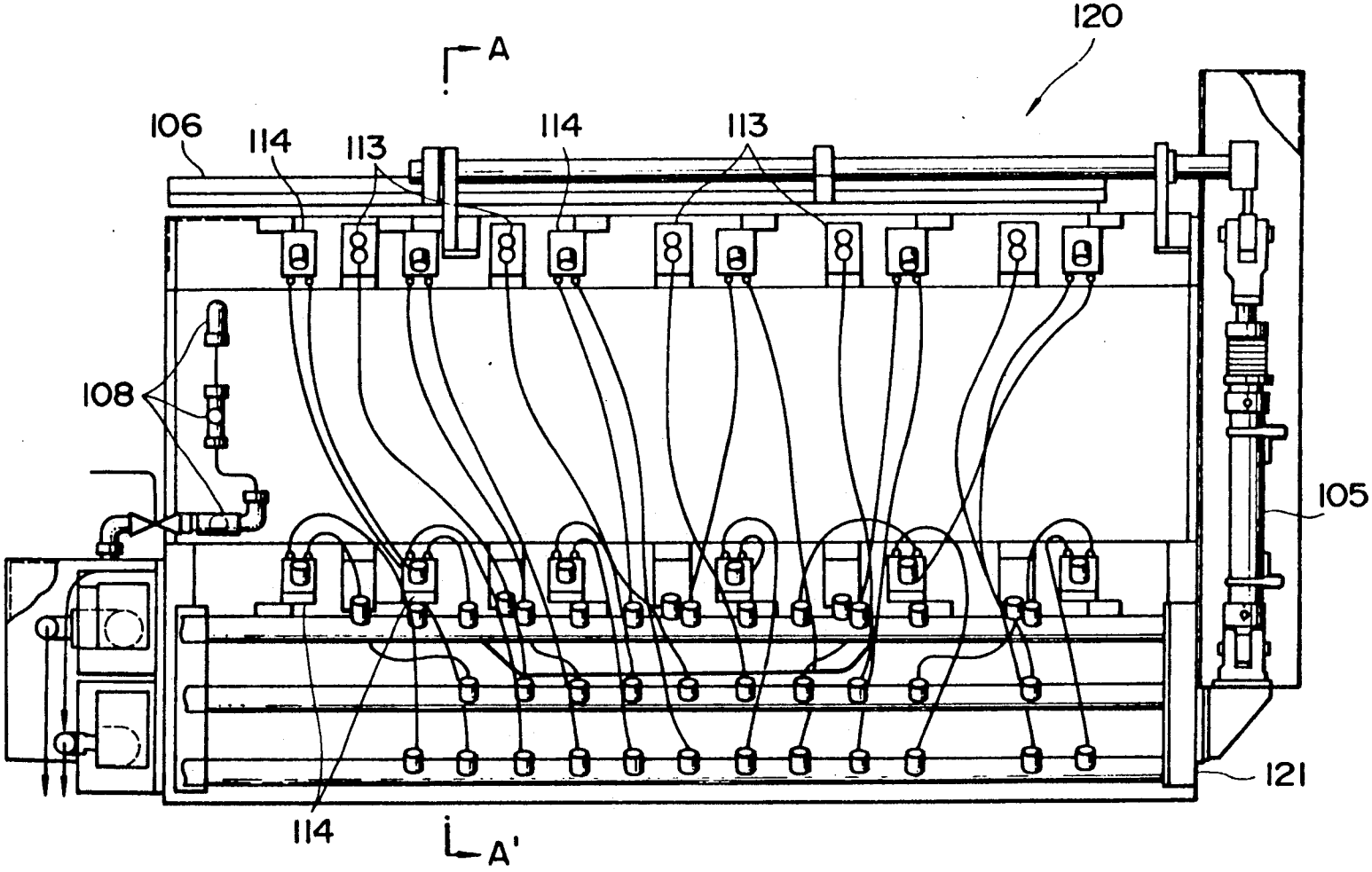
FIG. 4(*a*) is a front elevational view showing another structrure of the clearing apparatus.
Figure 4B:
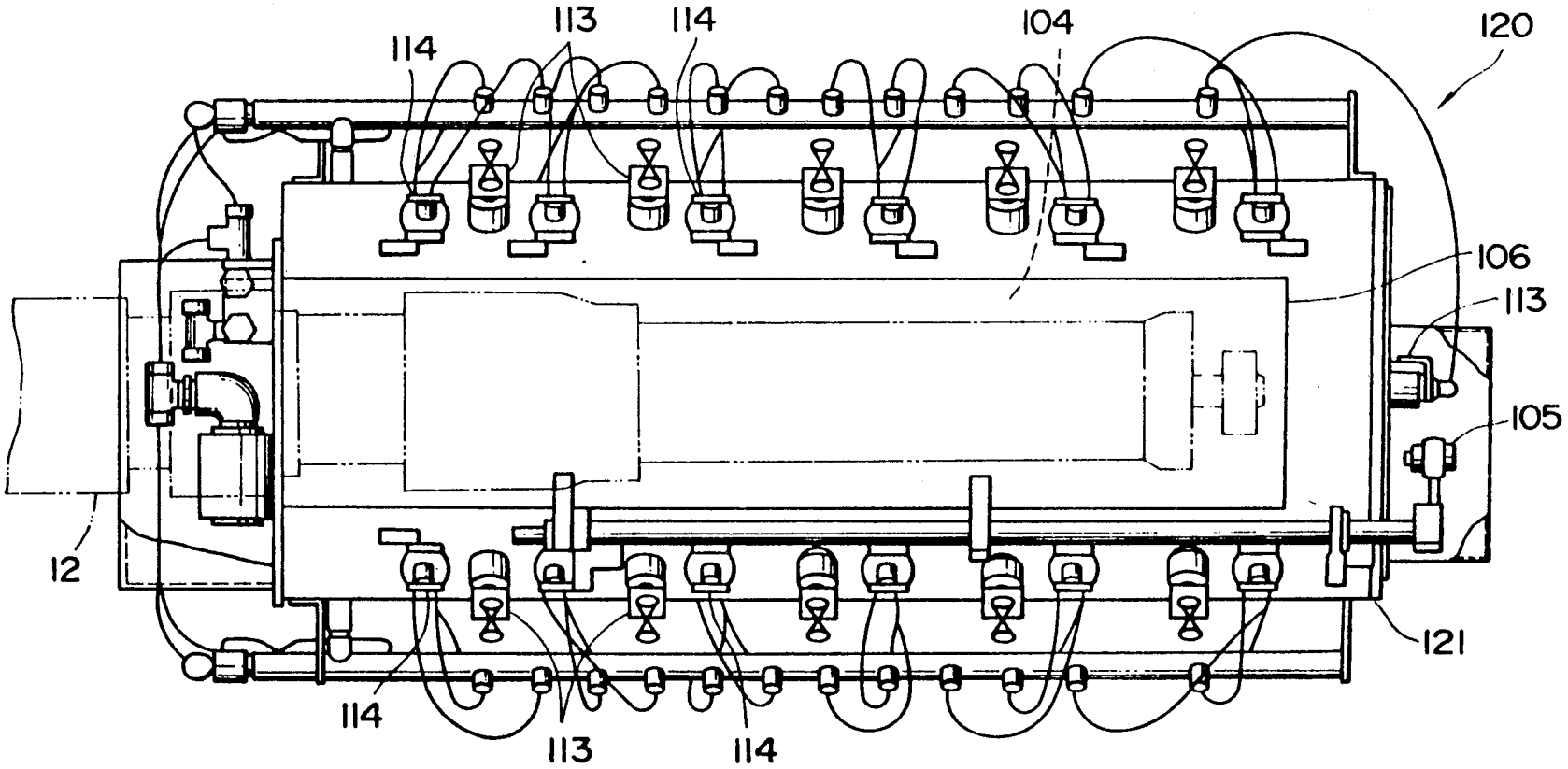
Figure 4C:
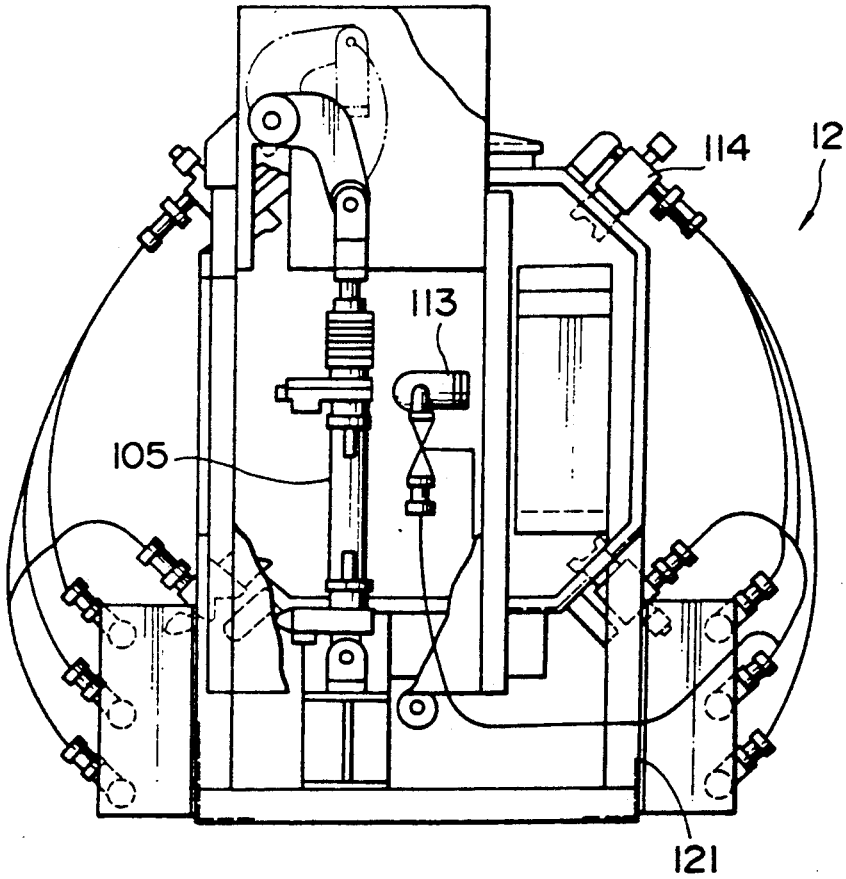
Figure 4D:
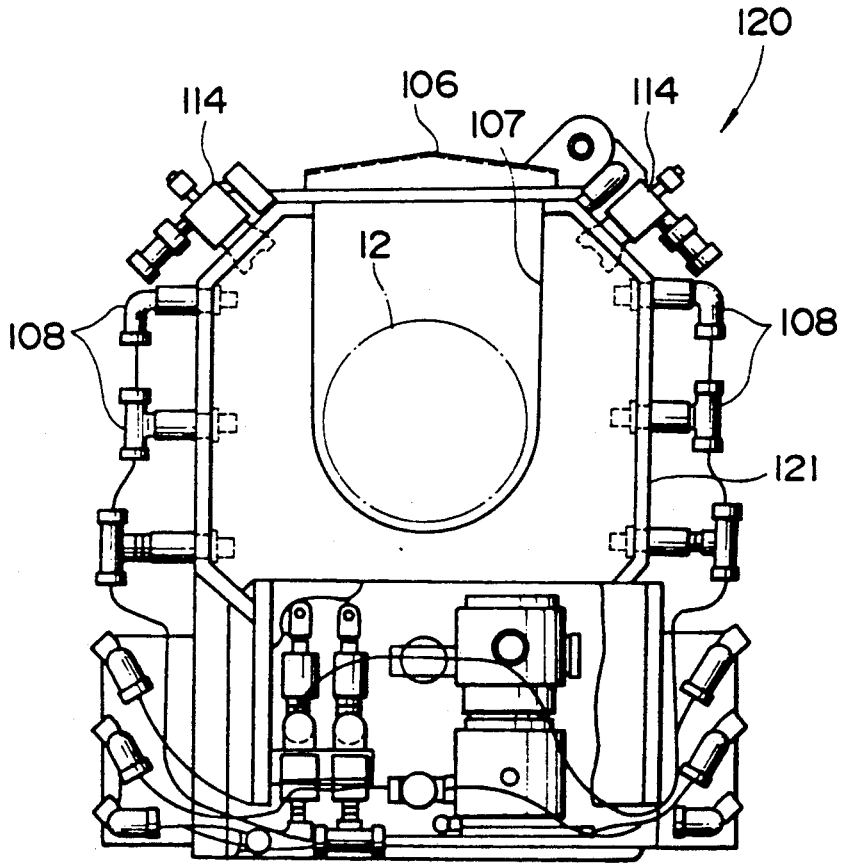
Figure 4E:
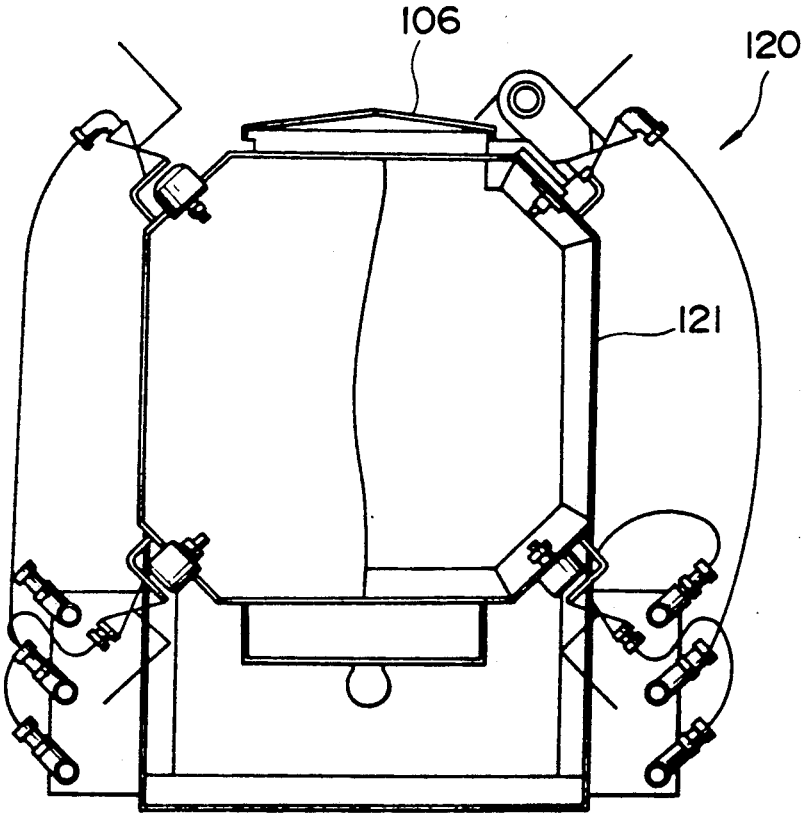
Figure 5A:
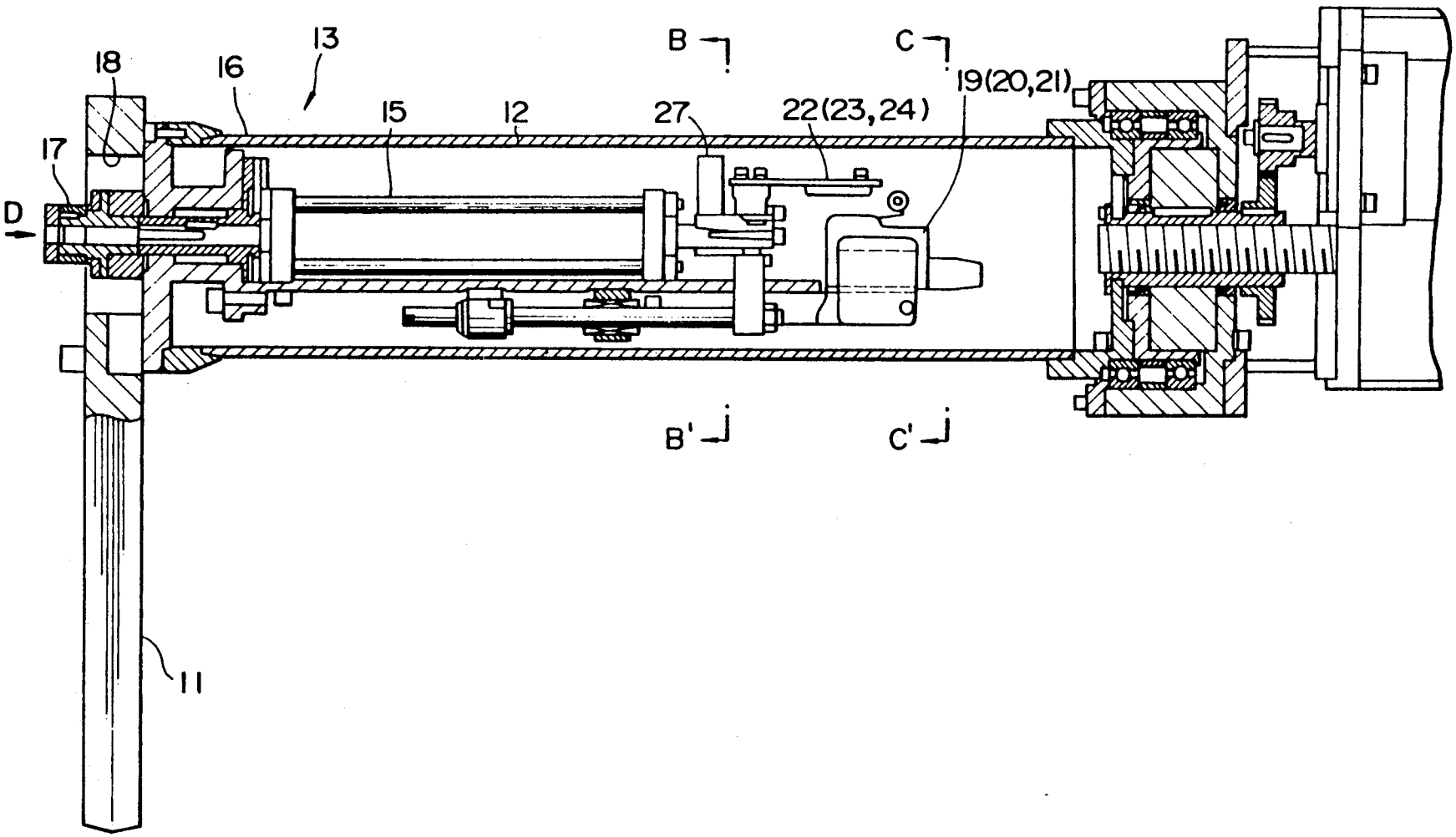
FIG. 5(*a*) is a sectional view showing structure of essential part of a trunk or bonnet opener constituting the painting system.
Figure 5B:
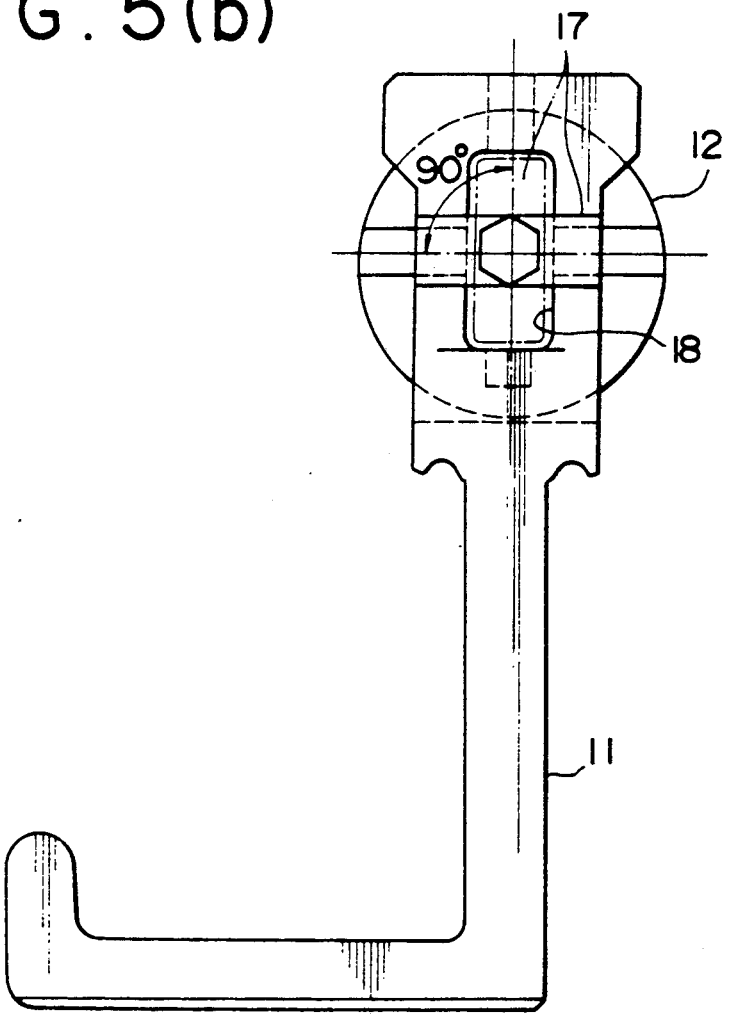
Figure 5C:
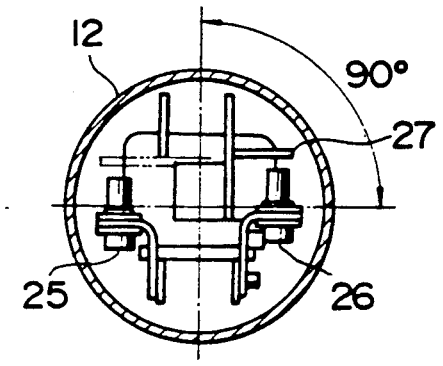
Figure 5D:
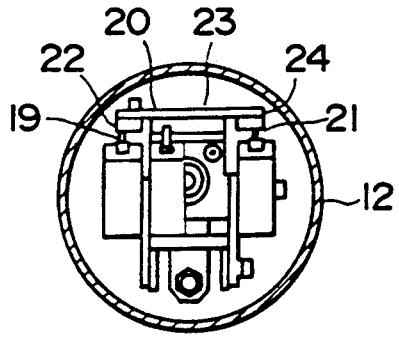

The painting system of the present embodiment is constituted such that it comprises, as shown in FIGS. 1 and 2, a washing apparatus disposed in the proximity of each of the robots for automatically washing an arm portion and an end portion of the robot, and controlling means for controlling the robots to operate to paint an automobile 40 and controlling the washing apparatus and the robots to operate to wash the robots after a suitable interval of time (for example, a cycle time interval of the robot, a rest time or upon completion of operation) in accordance with a degree of soiling of the robots.

Such robots include a plurality of painting robots 41 which are controlled by way of a painting robot control panel 51, a pair of door openers 42 which are controlled by way of a door opener control panel 52, a trunk opener 43 which is controlled by way of a trunk opener control panel 53 and a bonnet opener 44 which is controlled by way of a bonnet opener control pannel 54.

It is to be noted that, in the present embodiment, an opener jig 11 is attached to an end portion of an arm 12 of each of the trunk opener 43 and the bonnet opener 44 of the painting system. Then, since the degree of soiling of the opener jigs 12 upon painting operation is very high and considerable time is required for washing of the opener jigs 12, a structure is employed for permitting an opener jig 11 to be removably mounted on an arm 12 and two washing apparatus for washing the opener jigs 11 are installed for each of the trunk opener 43 and the bonnet opener 44 so that, while one of the opener jigs 11 is used, the other opener jig 11 may be washed in order to improve the efficiency in painting operation.

The washing apparatus mentioned hereinabove include a plurality of painting robot washing apparatus 55, a pair of door opener washing apparatus 56, a trunk opener washing apparatus 57, a bonnet opener washing apparatus 58, a trunk opener jig washing apparatus 59, a bonnet opener jig washing apparatus 60 and so forth. In the several washing apparatus listed, the trunk opener jig washing apparatus 59 is installed at a location higher than the trunk opener washing apparatus 57.

The washing apparatus are controlled by a washing apparatus control panel 61, and the control panels 51, 52, 53, 54, and 61 mentioned above are controlled by a line control panel 62 and a stage control panel 63. In particular, in response to a type of an automobile transported to the washing apparatus in a booster on the conveyor, a corresponding label is shifted by the line control panel 62, and in response to such signal, program numbers of the individual robots and/or instruction signals such as washing operation instructions are outputted to the control panels from the stage control panel 63 which controls the painting system for each stage.

The control means is realized by processing programs stored in advance in memories in the stage control panel 63 and the control panels 51, 52, 53, 54 and 61.

Then, the control means either operates in accordance with a progrm having different procedures for a painting operation and a washing operation or operates in accordance with a program having a series of procedures for both of a painting operation and a washing operation (a painting operation and a washing operation are included in a series of steps).

Subsequently, principal components of the painting system will be described in detail.

First, each of the trunk opener 43 and the bonnet opener 44 includes, as shown in FIGS. 5(*a*) to 5(*d*), an opener jig 11 having an L-shaped side elevation, and a holding mechanism 13 for removably holding the opener jig 11 on an arm 12 of the trunk opener 43 or bonnet opener 44.

The holding mechanism 13 includes a so-called robot cylinder 16, for example, of the air-operated type disposed at the position of an axis of the arm 12. The robot cylinder 15 has a plurality of, three in the embodiment shown, air supply ports formed therein through which compressed air is supplied to the robot cylinder 15 by rendering corresponding solenoid valves operative in a suitable order. Thus, a rod 16 of the robot cylinder 15 operates in the following sequence. In particular, advance ⟶ turn by 90 degrees at advanced position ⟶ retract ⟶ advance ⟶ reversely turn by 90 degrees at advanced position ⟶ retract.

A clamp jig 17 having a rectangular front elevation is attached to an end portion of the rod 16. A through-hole 18 for passing the clamp jig 17 therethrough is perforated at a longitudinal position at a base end side of the opener jig 11.

Then, when the clamp jig 17 is in an upwardly erected condition and the rod 16 of the robot cylinder 15 is at its retracted position in FIG. 5 (*b*), the through-hole 18 of the opener jig 11 is aligned in an opposing relationship with the clamp jig 17. After the rod 16 is further advanced, it is turned by 90 degrees and then retracted. Consequently, the opener jig 11 is left in a held condition on the arm 12.

On the other hand, when the rod 16 is advanced again and then turned reversely by 90 degrees whereafter it is retracted, the clamp member 17 is put into a condition wherein it is allowed to separate from the arm 12.

In order to assure such operation as described above, a plurality of limit switches and proximity switches are provided in the holding mechanism 13.

Such limit switches include a limit switch 19 for the confirmation of holding, another limit switch 20 for the confirmation of an error in holding and of the retracted position of the opening/closing apparatus, and a further limit switch 21 for the confirmation of removal. The limit switches 19, 20 and 21 operate when they are engaged with three cam plates 22, 23, and 24, respectively. In particular, the limit switch 21 operates at a forward limit position of the rod 16: the limit switch 20 operates at a rearward limit position of the rod 16: and the limit switch 19 operates at a position at which the opener jig 11 is held by the rod 16.

The proximity switches include a proximity switch 25 for the confirmation of a counterclockwise limit position of the rod 16, and another proximity switch 26 for the confirmation of a clockwise limit position of the rod 16. Each of the proximity switches 25 and 26 operates when a rocking lever 27 which is rocked upon rotation of the rod 16 approaches the same.

Then, judgment of the limit switch 20 in confirmation of an error in holding or the retracted position of the opener jig 11 depends upon output conditions of signals from the proximity switches 25 and 26. In particular, when the proximity switch 26 is in an on-state and also the limit switch 20 is in an on-state, an error in holding of the opener jig 11 is judged. When the proximity switch 25 is in an on-state and also the limit switch 20 is in an on-state, it is judged that the rod 16 is at its retracted position.

Since the holding mechanism 13 for the opener jig 11 is provided as described above, the opener jig 11 can be removed very readily from the opening/closing apparatus, and paint sticking to the opener jig 11 in a painting operations can be removed very easily.

Then, the holding mechanism 13 is rendered operative to remove the opener jig 11, and after that another new opener jig is attached to the holding mechanism 13 and a painting operation is performed. Consequently, an assembling operation can be performed in a very high efficiency without stopping the production line for an automobile.

Meanwhile, the opener jig 11 removed from the arm 12 is automatically washed by the washing apparatus 59 or 60 which will be hereinafter described in detail. After paint is removed from the opener jig 11, it can be attached again to the arm 12 to perform a painting operation.

Further, since the opener jig 11 can be removed from the arm 12 as described above, when a painting operation is interrupted, the arm 12 which is very simple in configuration after the opener jig 11 has been removed therefrom can be washed very efficiently.

Figure 6A:
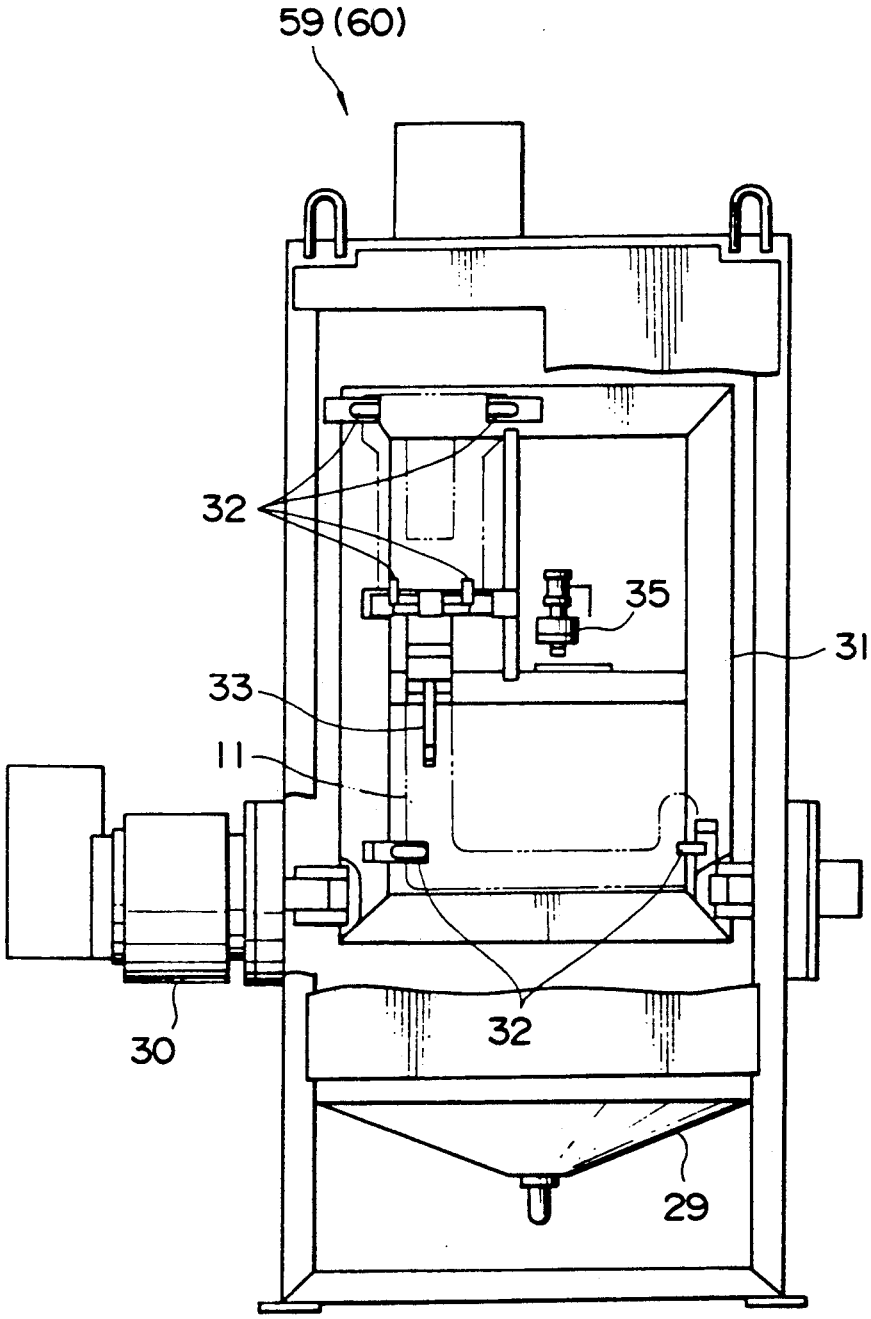
FIG. 6(*a*) is a front elevational view, partly broken, showing structure of an apparatus for washing an opener jig constituting the trunk or bonnet opener.
Figure 6B:
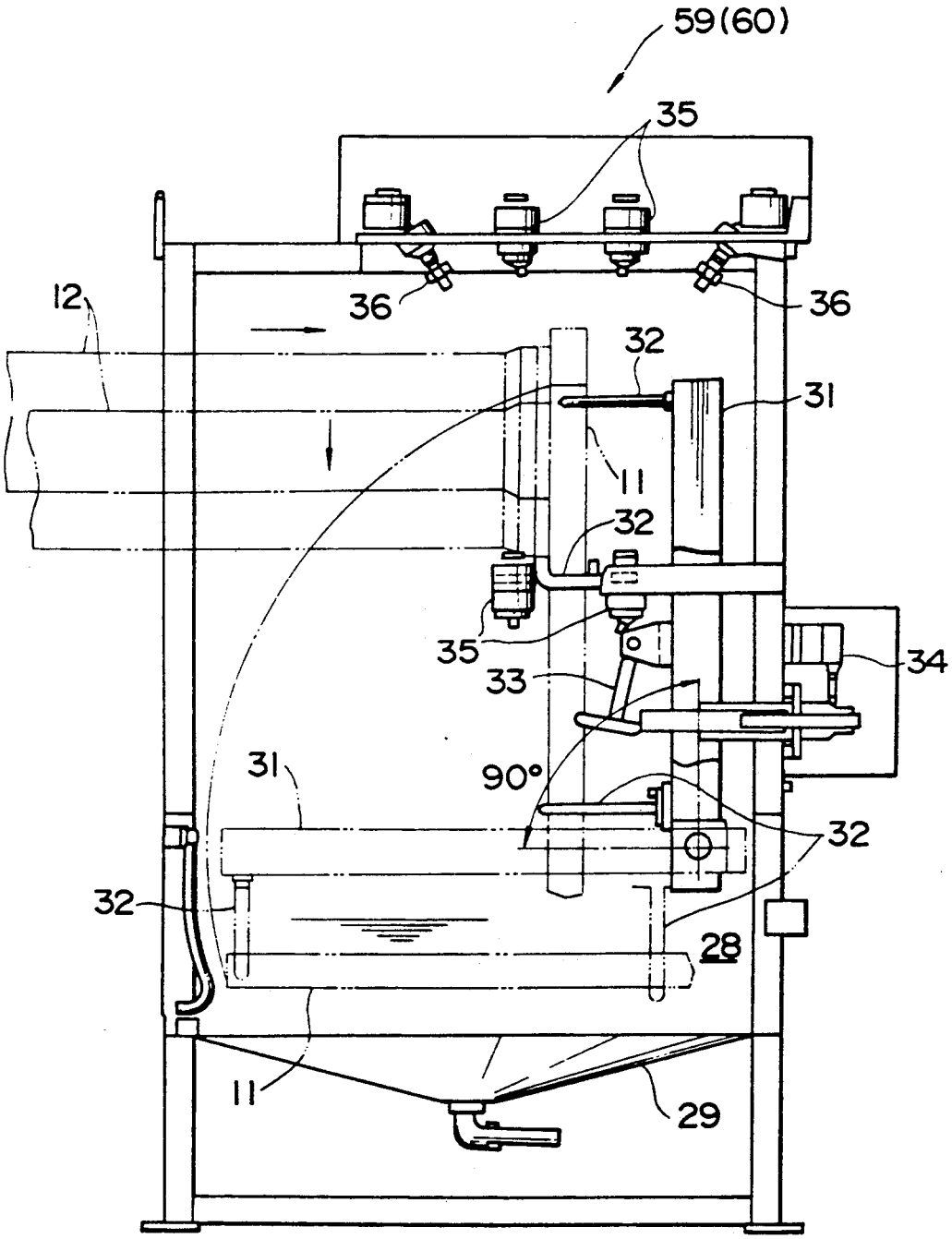

Subsequently, the washing apparatus 59 and 60 for a jig will be described with reference to FIGS. 6(*a*) and 6(*b*).

It is to be noted that the washing apparatus 59 and 60 have the same structure and are individually provided by two units for each robot.

In particular, in the case of, for example, the washing apparatus 59, a frame member 31 is disposed above a thinner layer 29 filled with a predetermined amount of thinner 28. The frame member 31 is rocked by a rocking motor 30 in a condition wherein it holds an opener jig 11 thereon. A plurality of hooks 32 are mounted on a front face portion of the frame member 31 for engaging with suitable portions of an opener jig 11 to hold the same thereon. Attachment of an opener jig 11 to the frame member 31 is confirmed as operation of a rocking lever 33 which is engaged with and rocked by the opener jig 11 is detected by a limit switch 34.

Further, a plurality of nozzles 35 for the discharging of washing thinner and another plurality of nozzles 36 for the discharging of drying air are disposed around the frame member 31.

The washing apparatus 59 and 60 in the embodiment of the present invention are constructed in such a manner as described above.

then, a washing operation of an opener jig 11 after completion of a painting operation is performed in the following procedure.

First, the end portion of the arm 12 of the trunk opener 43 or bonnet opener 44 is advanced into the washing apparatus 59 or 60 and positioned at a predetermined position. Then, the opener jig 11 is engaged with the hooks 32, and in this condition, the opener jig 11 is removed from the arm 12 in the procedure described hereinabove.

To the arm 12 from which the opener jig 11 has been removed, the other opener jig is attached, for example, from the other washing apparatus 59 or 60 disposed adjacent the washing apparatus 59 or 60, and the second opener jig 11 operates to perform a next painting operation. The frame member 31 on which the opener jig 11 in held by means of the hooks 32 is driven to be rocked downwardly by the rocking motor 30.

When the frame member 31 is rocked in such a manner as described above, the opener jig 11 is put into a condition wherein it is dipped in the thinner in the thinner layer 29. As a result, paint sticking to a surface of the opener jig 11 is removed actually or is put into a condition wherein it can be removed comparatively readily.

Then, after lapse of a predetermined interval of time, the rocking motor 30 is driven to be rocked in the reverse direction, whereupon the opener jig 11 supported on the frame member 31 is returned to its initial erected condition.

After that , clean thinner is discharged from the nozzles 35 to the opener jig 11 to effect finish washing. After completion of such washing, the opener jig 11 is dried by drying air discharged from the nozzles 36, thereby completing a series of washing operations.

Then, while the second opener jig which has been attached to the arm 12 and used in place of the first opener jig 11 and consequently is in a soiled condition is washed by the other washing apparatus, the first opener jig 11 washed by the washing apparatus is attached to the arm 12 in the procedure described hereinabove, and then the opener operates to perform a painting operation again.

Accordingly, according to the apparatus of the present embodiment, paint sticking to an opener 11 can be removed very readily, and the operation efficiency of the production line for an automobile can be improved.

It is to be noted that the numbers of such washing appartus 59 and 60 as described above may be increased taking a washing time, a painting time and so forth for an opener 11 into consideration.

Further, the washing apparatus 59 and 60 may be modified such that the nozzles 35 for the discharging of washing thinner may be omitted or the thinner layer 29 may be omitted in accordance with a degree of adhesion of paint to the opener jig 11.

Furthermore, the thinner or air may be heated, when it is to be used. In order to reduce the drying time.

Subsequently, description will be given of the washing apparatus 55, 56, 57 and 58 for washing arm portions and end portions of the painting robots 41, door opener 42, trunk opener 43 and bonnet opener 44, respectively.

It is to be noted that the washing apparatus listed just above have different sizes in accordance with the arm portions and/or end portions of the robots but have a similar basic structure. Accordingly, description will be given below by way of an example of the trunk opener washing apparatus 57.

In particular, as shown in FIGS. 3(*a*) to 3(*d*), the washing apparatus 57 each includes a housing 102 having an opening 104 formed at an upper portion thereof in a longitudinal direction for inserting the arm 12 of the trunk opener 43 therein. A lid 106 is mounted in the opening 104, and it is driven to be opened or closed by a cylinder 105. Another opening 107 for inserting the arm 12 therein is also formed in a side portion of the housing 102. A plurality of air nozles 108 for forming an air curtain are disposed on the inner side of the opening 107 in the cashing 102.

A guide rail 109 is mounted in a longitudinal direction on a side portion of the housing 102. A bracket 110 is disposed on the guide rail 109. In particular, the bracket 110 is supported for sliding movement in the longitudinal direction of the guide rail 109 by means of a plurality of cam followers 111. The bracket 110 is driven to slidably move on the guide ray 109 by a cylinder 112 of the so-called rodless type.

A plurality of nozzles 113 (first blowing members) are disposed on a face of the bracket 110 in such a manner as to surround the arm 12 to be washed. The nozzles 113 are provided to spray solvent such as, for example, thinner to the arm 12. The thinner is injected from the nozzles 113 by a pressure of the thinner.

A plurality of guns 114 are mounted on the other face of the bracket 1110 in such a manner as to surround the arm 12 similarly as in the case of the nozzles 113.

Each of the guns 114 serves as a second blowing member for blowing compressed air in which thinner is mixed to the arm 12 in accordance with the principle of an atomizer to wash the arm 12 and also as a third blowing member for blowing only compressed air to the arm 12 to dry the arm 12 in a condition whierein supply of the thinner is interrupted.

In this instance, the nozzles 113 and guns 114 have discharging openings which are each constructed such that it may make a spraying pattern having an elliptical shape in a vertical direction with respect to the moving direction if the bracket 110 so that it may spray thinner or the like in such a manner as to surround an outer periphery of the arm 12.

It is to be noted that a spraying member or members having both of functions of the nozzles 113 and guns may be mounted on the bracket 110.

In this instance, a moving mechanism 115 for moving the nozzles 113 and guns 14 in a corresponding relationship to an area of the arm 12 to which paint sticks is constituted from the guide rail 109, bracket 111, cam followers 111, cylinder 112 and so forth.

Then, thinner compressed air or the like is supplied to each of the nozzles 113 and guns 114 by way of a pipe installed in a cable conveyor 116.

A thinner tank 117 and an overflow tank 118 for the recovery of thinner are disposed at a slower portion of the housing 102.

An intake port of a pump not shown is connected to the thinner tank 117. Thus, thinner in the thinner tank 117 is supplied to the nozzles 118 and guns 114.

The overflow tank 118 is constituted such that it discharges to the outside of the apparatus, for example, washing thinner which has been sprayed from the guns 14 and overflows from the thinner tank 117. Thinner overflowing from the overflow tank 118 is automatically discharged through a normally open cock 119. Then, as thinner overflows as described above, dirty thinner remaining in the thinner tank 117 is purified. As thinner which has been used for washing as described above is recovered and used again, the amount of consumption of thinner can be decreased, thereby to reduce the operation cost.

The washing apparatus 57 having such construction as described above are controlled to operate in such a procedure as hereinafter described by the washing apparatus control panel 61.

In particular, while the nozzles 113 and guns 114 are moved in a corresponding relationship to an area of the arm 12 to which paint sticks by the moving mechanism 115, thinner is sprayed to the arm 12 by way of the nozzles 113. Then, after a predetermined interval of time elapses, compressed air in which thinner is mixed is blown to the arm 12 by way of the guns 114 to wash the arm 12. Further, compressed air is blown to the arm 12 by way of the guns 114 to dry the arm 12.

According to the washing apparatus 57 of the painting system of the present embodiment, since thinner is sprayed to the arm 12 by way of the nozzle 113 and then the arm 12 is left as it is for a predetermined period of time (for a period of time sufficient for paint sticking firmly to the surface of the arm 12 to be put into a condition wherein it can be exfoliated from the surface of the arm 12) in prior to a washing operation to be performed by means of the guns 114 as described hereinabove. Accordingly, even such paint that sticks firmly to the surface of the arm 12 can be removed automatically and substantially completely.

Subsequently, description will be given of another washing apparatus 120 with reference to FIGS. 4(*a*) to 4(*e*).

It is to be noted that common elements to those of the washing apparatus 57 shown in FIGS. 3(*a*) to 3(*d*) are denoted by common reference numerals, and detailed description thereof is omitted herein.

The present washing apparatus 120 shown in FIGS. 4(*a*) to 4(*e*) is substantially similar in basic structure to that of the washing apparatus 57.

In particular, in the washing apparatus 120, a plurality of nozzles 113 for spraying solvent such as thinner to an arm 12 and a plurality of guns 114 for blowing compressed air in which thinner is mixed to the arm 12 in accordance with the principle of an atomizer to wash the arm 12 and for blowing only compressed air to the arm 12 to dry the arm 12 while interrupting supply of thinner are provided on the opposite sides of a housing 121 in a corresponding relationship to an area of the arm 12 to which paint sticks.

Then, the washing apparatus 120 is controlled in a substantially similar procedure as in the case of the washing apparatus 57.

In particular, thinner is sprayed to the arm 12 by way of the nozzles 113. Then, after a predetermined period of time elapses, gas in which thinner is mixed is blown to the arm 12 by way of the guns 114 to wash the arm 12. Further, compressed air is blown to the arm 12 by way of the guns 114 to dry the arm 12.

It is to be noted that the nozzles 113 and guns 114 are mounted in a stationary condition in the present washing apparatus 120. Then, the blowing pattern exhibits an elliptical shape in an axial direction of the arm 12. Accordingly, upon washing operation, the arm 12 must necessarily be rotated by at least 90 degrees around the axis thereof.

In this instance, in order that a washing operation may be performed while the arm 12 is kept in a stopping condition without rotating the same, a swinging mechanism may be provided for each of the nozzles 113 and guns 114 or each of the nozzles 113 and guns 114 may be turned around the arm 12.

Accordingly, also with the present washing apparatus 120, paint sticking firmly to the surface of the arm 12 can be removed automatically and substantially completely similarly as in the case of the washing apparatus 57.

It is to be noted that, while the washing apparatus 57 and 120 are both constituted such that a plurality of nozzles and a plurality of guns are provided in a corresponding relationship to an area of the arm 12 to which paint sticks as described above, where the painting equipment such as an arm which is an object for a washing operation is comparatively small in size, only one such nozzle and/or gun may be provided alternatively.

Figure 7A:
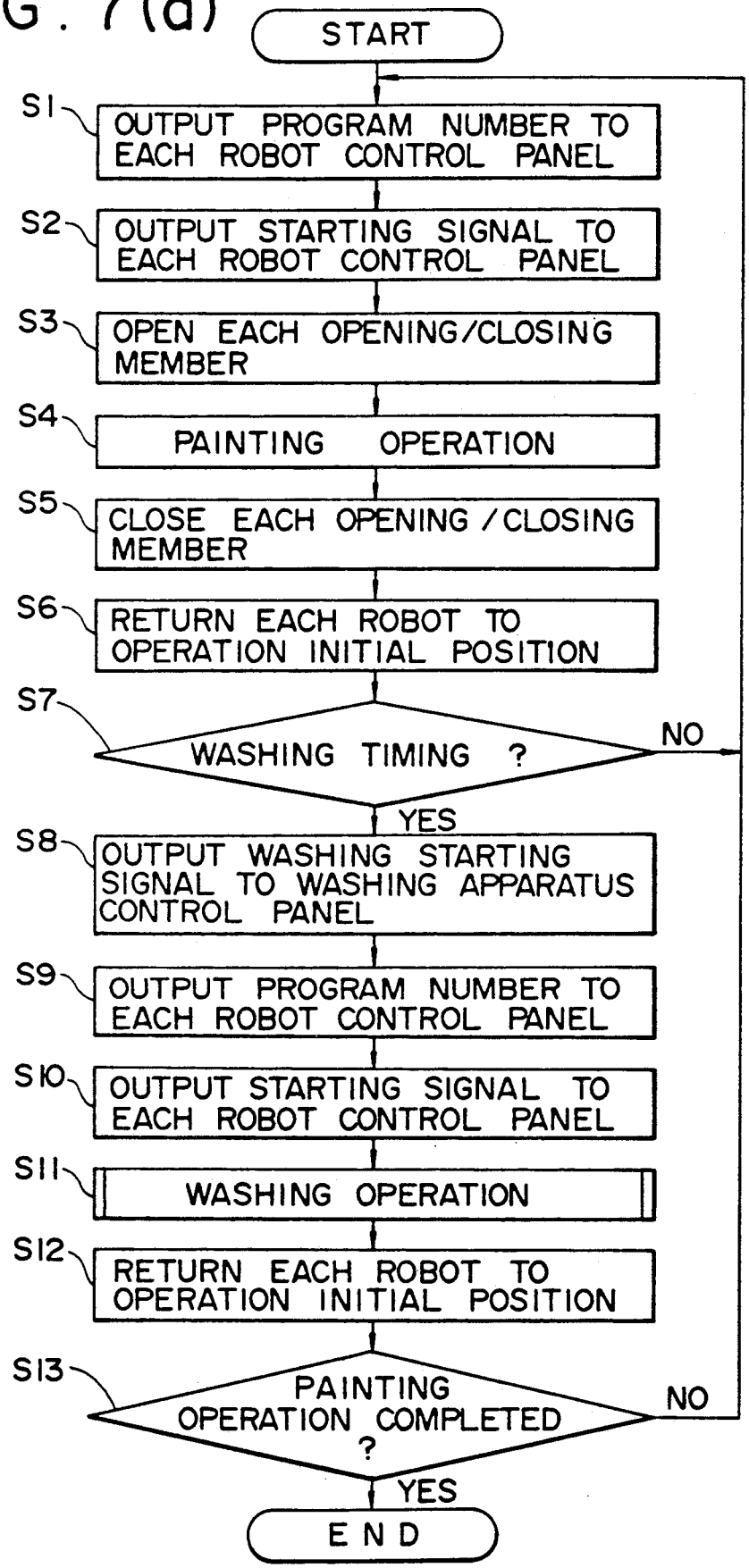
FIG. 7(*a*) is a flow chart illustrating a procedure when an automobile is painted by the painting system.
Figure 7B:
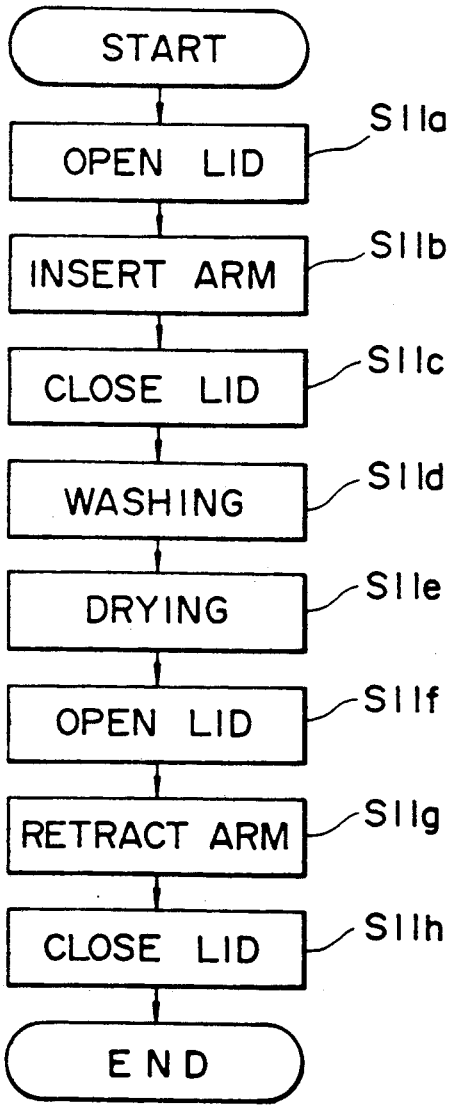
Figure 7C:
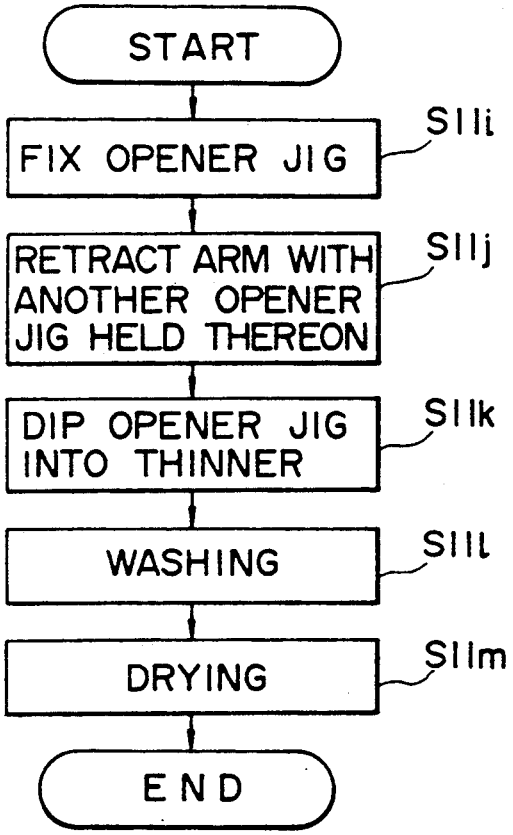

Subsequently, a procedure of painting an automobile 40 using the painting system of the embodiment described herinabove will be described with reference to FIGS. 7(*a*) to 7(*c*) in which reference characters S1, S2, . . . denote each an operation step.

First, a program number is outputted from the stage control panel 63 to the robot control panels 51, 52, 53 and 54 (S1), and then, a starting signal is outputted (S2). Consequently, the robots are rendered operative to open opening/closing members of the automobile 40 such as a door (S3), and then a painting operation is started (S4).

In particular, the doors 45 of the automobile 40 are opened and then kept in such open condition by the door openers 42, and then the inside of the automobile 40 and the rear faces of the doors 45 are painted by corresponding ones of the painting robots 41. Further, the trunk 46 of the automobile 40 is opened and then kept in such open condition by the trunk opener 43, and then the inside of the trunk room and the rear face of the trunk 46 are painted by a corresponding one of the painting robots 41. Further, the bonnet 47 of the automobile 40 is opened and then kept in such open condition by the bonnet opener 44, and then the inside of the engine room and the rear face of the bonnet 47 are painted by a corresponding one of the painting robots 41.

Painting is performed for the various inside portions of the automobile 40 in such a manner as described above, and after such operation is completed, the opening/closing members including the doors 45, trunk 46 and bonnet 47 are closed by the respective openers 42, 43 and 44 (S5).

After then, the robots 41, 42, 43 and 44 are returned to the respective operation initial point positions (S6).

Then, in case it is judged at step S7 that the arm portions or end portions of the arm portions of the individual robots are soiled with paint mist sticking thereto and then a washing timing such as a rest time comes, a washing staring signal is outputted from the stage control panel 63 to the washing apparatus control panel 61 (S8).

After then, a washing program number is outputted from the washing apparatus control panel 61 to the individual robot control panels 51, 52, 53 and 54 (S9), and then a starting signal is outputted (S10).

Subsequently at step S11, the robots are moved to the positions of the respective washing apparatus, and a washing operation is performed for the arm portions and/or end portions of the robots and further for the openers 11 in such a procedure as described hereinabove.

In particular, when washing is performed for the arm portions or end portions of the trunk opener 43, bonnet opener 44 and painting robots 41, for example the lid 106 of the washing apparatus 57 is opened (S11*a*), and the robot arm portion is inserted into the washing apparatus 57 (S11*b*). After then, the lid 106 is closed (S11*c*), and thinner is blown to an outer periphery of the arm from the nozzles 113. then, after the robot arm portion is left as it is for several seconds, thinner atomized by an air pressure is blown from the guns 114 to the robot arm portion to perform washing of the arm (S11*d*).

After the arm is washed in such a manner as described above, only air is discharged from the guns 114 to dry the arm (S11*e*).

After then, the lid 106 is opened and the arm is removed (S11*f*, S11*g*), and then the lid 106 is closed (S11*h*).

On the other hand, when the arm portion and the end portion of the door opener 42 is to be washed, the thinner blowing step from the nozzle 113 at step S11*d*in the procedure of the steps S11*a*to S11*h*is omitted, and a washing operation is performed by blowing thinner all atomized by an air pressure. The remaining steps of the procedure are similar to those of the steps S11*a*to S11*h*described above.

Further, when the opener jig 11 of any of the trunk opener 43 and the bonnet opener 44 is to be washed, first the arm of the opener is inserted, for example, into the washing apparatus 59, and the opener jig 11 is fixed to the hooks 32 in the washing apparatus 59 (S11*i*).

Then, another opener jig 11 which has been washed by and remains in a standby condition on the other washing apparatus 57 is attached to the arm 12 from which the opener jig 11 has been removed, and then the other opener jig 11 removed form the other washing apparatus 57 (S11*j*).

In the meantime, in the washing apparatus 59 in which the soiled opener jig 11 to which paint mist sticks is accommodated, the frame member 31 is driven to be rocked to dip the opener jig 11 into the thinner (S11*k*). Then, after a predetermined interval of time passes until a condition is reached wherein paint mist sticking to the surface of the opener 11 can be removed readily, the frame member 31 is returned to its initial position. After then, thinner is blown from the nozzles 35 to the opener jig 11 to effect finish washing (S11*l*). After completion of such washing, the opener jig 11 is dried by drying air discharged from the nozzles 36, thereby completing a sequence of washing operation (S11*m*).

The opener jig 11 after washing enters a standby condition in the washing apparatus 59.

After washing operation for the arm portion and end portion of the robot are completed in such a manner as described above, the individual robots are returned to their respective operation initial positions (S12).

Such a sequence of operations as described above is repeated suitably until it is judged at step S13 that all necessary painting operation has been completed.

It is to be noted that, in any washing operation, air, thinner or the like may be heated suitably, when it is to be used, in order to reduce the drying time.

Further, while the operations of the procedure described above are based on the programs taught in the different procedures for the painting operation and the washing operation, where they are based on a program taught in a series of procedures for the painting operation and the washing operation, that is, where a painting operation and a washing operation are included in a series of operation steps, the steps S8, S9 and S10 of the operation steps described above should be omitted.

A series of operations is performed in such a procedure as described above by the painting system of the present embodiment.

Accordingly, with the present painting system, paint mist sticking to the robots can be washed very readily without requiring manual operation of an operator.

We claim:

1. A painting system for painting an automobile, comprising:

a plurality of robots including a painting robot, and an opener robot, said opener robot including an arm for supporting an opener jig engageable with an opening/closing member of the automobile so as to open or close the opening/closing member;

holding means on said arm for releasably holding the opener jig on said arm;

a washing apparatus disposed in proximity to each of said robots for washing said robots and said opener jig, such that said opener jig released from said arm by said holding means may be received therein; and control means for controlling said painting robot to paint the automobile and for controlling said robots and said washing apparatus to periodically wash at least said opener jig.

2. A painting system according to claim 1 wherein said control means includes means for controlling said holding means to release the opener jig when the washer jig is supported by said washing apparatus so that said opener jig may be washed.

3. A painting system for an automobile according to claim 1, wherein said control means operates in accordance with a program having different procedures for a painting operation and a washing operation.

4. A painting system for an automobile according to claim 1, wherein said control means operates in accordance with a program having a series of procedures for a painting operation and a washing operation.

5. A painting system for an automobile according to any one of claims 3, 4 or 1, wherein each of said washing apparatus for washing said robots has means to first spray solvent to a corresponding one of said robots, leave the robot as it is for a predetermined period of time, blow gas in which solvent is mixed to the robot to wash the robot, and blow air to the robot to dry the robot.

6. A painting system for an automobile according to any one of claims 3, 4 or 1, wherein each of said washing apparatus includes one or more first, second and third blowing members provided in a corresponding relationship to an area of each of said robots to which paint sticks for spraying solvent to the robot, for blowing gas in which solvent is mixed to the robot to wash the robot and for blowing gas to the robot to dry the robot, respectively, and control means for controlling the washing apparatus such that solvent is sprayed to the robot by said first blowing member, and after lapse of a predetermined interval of time, gas in which solvent is mixed is blown to the robot by said second blowing member to wash the robot, whereafter gas is blown to the robot by said third blowing member by dry the robot.

7. A painting system for an automobile according to any one of claims 3, 4 or 1 wherein each of said washing apparatus first sprays solvent to a corresponding one of said robots, leaves the robot as it is for a predetermined period of time, blows gas in which solvent is mixed to the robot to wash the robot, and blows air to the robot to dry the robot.

* * * * *